US009031463B2

(12) United States Patent
Arai et al.

(10) Patent No.: US 9,031,463 B2
(45) Date of Patent: May 12, 2015

(54) ELECTROPHOTOGRAPHIC PHOTOCONDUCTOR, IMAGE FORMING METHOD, IMAGE FORMING APPARATUS AND PROCESS CARTRIDGE

(75) Inventors: Yoko Arai, Shizuoka (JP); Keisuke Kamitsu, Shizuoka (JP); Shinichi Togashi, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 553 days.

(21) Appl. No.: 13/162,972

(22) Filed: Jun. 17, 2011

(65) Prior Publication Data

US 2012/0003007 A1 Jan. 5, 2012

(30) Foreign Application Priority Data

Jun. 30, 2010 (JP) ..... 2010-149861
Jun. 30, 2010 (JP) ..... 2010-150013

(51) Int. Cl.
*G03G 15/00* (2006.01)

(52) U.S. Cl.
CPC ..... *G03G 15/751* (2013.01)

(58) Field of Classification Search
CPC ..... G03G 15/751
USPC ..... 399/116, 159
See application file for complete search history.

(56) References Cited

U.S. PATENT DOCUMENTS

| | | | | |
|---|---|---|---|---|
| 6,605,399 | B2 * | 8/2003 | Chowdry et al. | 430/62 |
| 6,937,830 | B2 * | 8/2005 | Satoh | 399/92 |
| 2003/0161662 | A1 * | 8/2003 | Kim et al. | 399/162 |
| 2007/0092298 | A1 * | 4/2007 | Kamoshida et al. | 399/168 |
| 2008/0044202 | A1 * | 2/2008 | Takemoto et al. | 399/159 |
| 2009/0197195 | A1 * | 8/2009 | Sakai et al. | 430/125.3 |

FOREIGN PATENT DOCUMENTS

| | | |
|---|---|---|
| JP | 01-177042 | 7/1989 |
| JP | 01-285953 | 11/1989 |
| JP | 04-108899 | 4/1992 |
| JP | 06-118679 | 4/1994 |
| JP | 11-338310 | 12/1999 |
| JP | 2002-287395 | 10/2002 |
| JP | 2004-29833 | 1/2004 |
| JP | 2005-186253 | 7/2005 |
| JP | 2005-292294 | 10/2005 |
| JP | 2006-255881 | 9/2006 |
| JP | 2007-25270 | 2/2007 |
| JP | 2008-292882 | 12/2008 |

OTHER PUBLICATIONS

Japanese official action dated. Feb. 27, 2014 in corresponding Japanese patent application No. 2010-150013.
Japanese official action dated Feb. 27, 2014 in corresponding Japanese patent application No. 2010-149861.

* cited by examiner

*Primary Examiner* — Walter L Lindsay, Jr.
*Assistant Examiner* — Jessica L Eley
(74) *Attorney, Agent, or Firm* — Cooper & Dunham LLP

(57) ABSTRACT

An electrophotographic photoconductor including a metal tube and a photoconductive layer on the metal tube, wherein the metal tube has an outer diameter of 40 mm to 300 mm, and has a total runout of 5 μm to 70 μm relative to a driving axis thereof.

4 Claims, 6 Drawing Sheets

ELECTROPHOTOGRAPHIC PHOTOCONDUCTOR, IMAGE FORMING METHOD, IMAGE FORMING APPARATUS AND PROCESS CARTRIDGE

BACKGROUND OF THE INVENTION

1. Field of the Invention

The present invention relates to an electrophotographic photoconductor; and an image forming method, an image forming apparatus and a process cartridge each using the electrophotographic photoconductor.

2. Description of the Related Art

In recent years, image forming apparatuses such as copiers, laser printers and facsimiles have increasingly been required to achieve high image quality.

Electrophotographic photoconductors used for image formation are rotated and subjected to necessary or intended treatments such as charging, latent image formation, developing and transferring with various units arranged around them.

For achieving high image quality, it is necessary to perform each treatment uniformly on the entire electrophotographic photoconductor. The electrophotographic photoconductors are rotated during these treatments and thus, are required to have high runout accuracy.

In general, an electrophotographic photoconductor has a metal tube and a photoconductive layer, and flanges are provided at openings of both ends of the metal tube.

The metal tube is produced through extruding, drawing and surface treatment.

For example, Japanese Patent Application Laid-Open (JP-A) No. 2007-025270 discloses a metal tube having a total runout of 80 μm relative to a driving axis thereof.

However, use of such a metal tube having a large total runout cannot accurately superpose multicolor images on top of another (inaccurate superposition of multicolor images), not providing high-quality images. Further, the metal tube is a hollow tube and thus, the larger the outer diameter thereof, the more difficult attainment of high runout accuracy.

Extrusion for producing a metal tube has generally been performed with the porthole method. However, as disclosed in JP-A No. 2002-287395, the metal tube produced with the porthole method has a seam, so that it has a low inner-diameter roundness. Even when this metal tube is subjected to drawing and surface treatments, an electrophotographic photoconductor having a high runout accuracy cannot be obtained.

Also, conventionally, in an attempt to attain high total runout accuracy, the metal tube is cut with its deformation or strain being corrected by holding means (see JP-A Nos. 2008-292882 and 2006-255881). However, even in this case, when released from the holding means after completion of cutting, the metal tube is returned to the original shape; i.e., deformed or strained again, problematically causing a drop in total runout accuracy.

In the recent applications such as full color printing, inaccurate superposition of multicolor images becomes problematic. Especially in image forming apparatuses for the commercial printing market, the number of toners increases from four—black, yellow, magenta and cyan—to five or six—those four colors plus clear color and/or special color, in order to respond to a variety of printing applications. Thus, inaccurate superposition of multicolor images becomes problematic more and more.

BRIEF SUMMARY OF THE INVENTION

An object of the present invention is to consistently provide an electrophotographic photoconductor having a high dimensional accuracy, in order to suppress such inaccurate superposition to the greatest extent possible.

Means for solving the above existing problems are as follows.

<1> An electrophotographic photoconductor including:

a metal tube, and a photoconductive layer on the metal tube, wherein the metal tube has an outer diameter of 40 mm to 300 mm, and has a total runout of 5 μm to 70 μm relative to a driving axis thereof.

<2> The electrophotographic photoconductor according to <1>, wherein the outer diameter is 40 mm to 150 mm and the total runout is 5 μm to 50 μm.

<3> The electrophotographic photoconductor according to <2>, wherein the metal tube is processed through mandrel extrusion, and has an inner-diameter roundness of 5 μm to 50 μm after the mandrel extrusion.

<4> An image forming method including:

charging a surface of the electrophotographic photoconductor according to any one of <1> to <3>, exposing the charged surface of the electrophotographic photoconductor to form a latent electrostatic image, developing the latent electrostatic image with a toner to form a visible image, and transferring the visible image onto a recording medium.

<5> An image forming apparatus including:

the electrophotographic photoconductor according to any one of <1> to <3>, a charging unit configured to charge a surface of the electrophotographic photoconductor, an exposing unit configured to expose the charged surface of the electrophotographic photoconductor to form a latent electrostatic image, a developing unit configured to develop the latent electrostatic image with a toner to form a visible image, and a transfer unit configured to transfer the visible image onto a recording medium.

<6> A process cartridge including:

the electrophotographic photoconductor according to any one of <1> to <3>, a developing unit configured to develop, with a toner, a latent electrostatic image on the electrophotographic photoconductor to form a visible image, wherein the process cartridge is detachably mounted to a main body of an image forming apparatus.

<7> The electrophotographic photoconductor according to <1>, wherein the outer diameter is 150 mm to 300 mm and the total runout is 10 μm to 70 μm.

<8> The electrophotographic photoconductor according to <7>, wherein the metal tube is processed through mandrel extrusion, and has an inner-diameter roundness of 10 μm to 70 μm after the mandrel extrusion.

<9> An image forming method including:

charging a surface of the electrophotographic photoconductor according to any one of <1>, <7> and <8>, exposing the charged surface of the electrophotographic photoconductor to form a latent electrostatic image, developing the latent electrostatic image with a toner to form a visible image, and transferring the visible image onto a recording medium.

<10> An image forming apparatus including:

the electrophotographic photoconductor according to any one of <1>, <7> and <8>, a charging unit configured to charge a surface of the electrophotographic photoconductor, an exposing unit configured to expose the charged surface of the electrophotographic photoconductor to form a latent electrostatic image, a developing unit configured to develop the latent electrostatic image with a toner to form a visible image, and a transfer unit configured to transfer the visible image onto a recording medium.

<11> A process cartridge including:

the electrophotographic photoconductor according to any one of <1>, <7> and <8>, a developing unit configured to develop, with a toner, a latent electrostatic image on the electrophotographic photoconductor to form a visible image, wherein the process cartridge is detachably mounted to a main body of an image forming apparatus.

The present invention can consistently provide an electrophotographic photoconductor with a high runout accuracy which suppresses inaccurate superposition of multicolor images; and an image forming method, an image forming apparatus and a process cartridge each using the electrophotographic photoconductor.

DETAILED DESCRIPTION OF THE INVENTION

An electrophotographic photoconductor of the present invention includes a metal tube and a photoconductive layer on the metal tube, wherein the metal tube has an outer diameter of 40 mm to 300 mm and has a total runout of 5 μm to 70 μm relative to a driving axis thereof.

In a first embodiment, the metal tube has an outer diameter of 40 mm to 150 mm and has a total runout of 5 μm to 50 μm relative to a driving axis thereof.

In a second embodiment, the metal tube has an outer diameter of 150 mm to 300 mm and has a total runout of 10 μm to 70 μm relative to a driving axis thereof.

As can be understood from the above means for solving the problems, the present invention focuses on inner-diameter roundness which has not yet been focused on.

That is, instead of strengthening holding force of holding means applied for correcting deformation or strain of a metal tube, the present inventors conducted various attempts to attain high total runout accuracy even with low holding force, and have found that it is not necessary to apply extra force for correcting deformation or strain of a metal tube during cutting by increasing the metal tube in inner-diameter roundness. As a result, after completion of cutting, the metal tube is not returned to the original shape; i.e., not deformed or strained again, leading to attainment of high total runout accuracy.

Also, production by a molding method involving rotation requires a long period of time, while production of a molding method involving no rotation is considerably low cost. Conceivably, almost all the metal tubes for photoconductors are produced by a molding method involving no rotation. The effects obtained by increasing the inner-diameter roundness of the metal tube become considerably large when processing (e.g., cutting) is performed while the metal tube is being held at the inner surface thereof.

Figure 5:
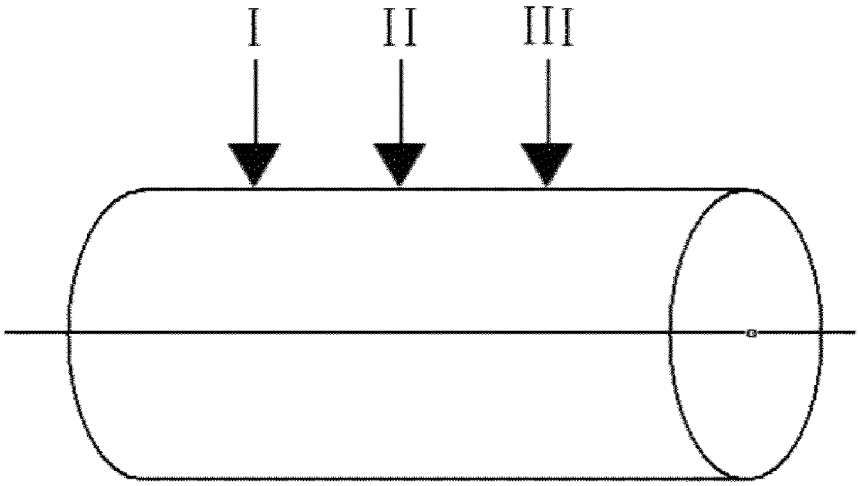
FIG. 5 is an explanatory view of a single runout or a total runout in the present invention.

Next will be described a measuring method for "total runout relative to a driving axis" in the present invention. As illustrated in FIG. 5, (1) a photoconductor (cylinder) is rotated with the central axis (driving axis) fixed; (2) the distances from the central axis to positions (I), (II) and (III) in FIG. 5 are measured using any means such as a laser or a dial gauge (note that the number of positions is not limited to three); (3) the difference between the maximum and minimum values measured while the photoconductor is rotated once is defined as a runout (a single runout) at each position; and (4) the maximum value of the single runouts is defined as a total runout.

Also, the term "roundness" in the present invention is a value measured according to JIS B 0621-1984, and refers to a measure of deviation from a geometrically-accurate circle in a circular form. The roundness is expressed by the difference between the radii of two geometrically-accurate, concentric circles which sandwich a circular form and whose interval becomes minimum.

Figure 6:
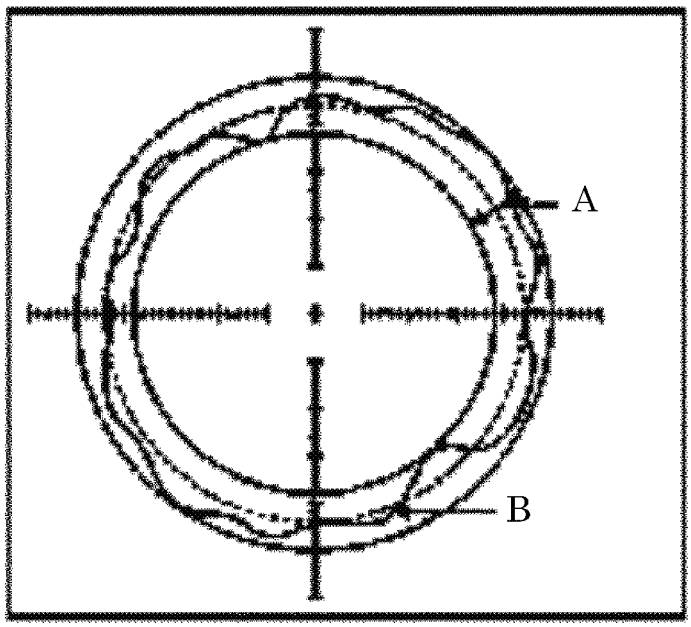
FIG. 6 is an explanatory view of a roundness in the present invention, where A denotes a roundness and B denotes a recorded figure.

Also, the term "circular form" refers to a line which is functionally a circle such as a circular shape or a trajectory of circular motion, as illustrated in FIG. 6.

Figure 7:
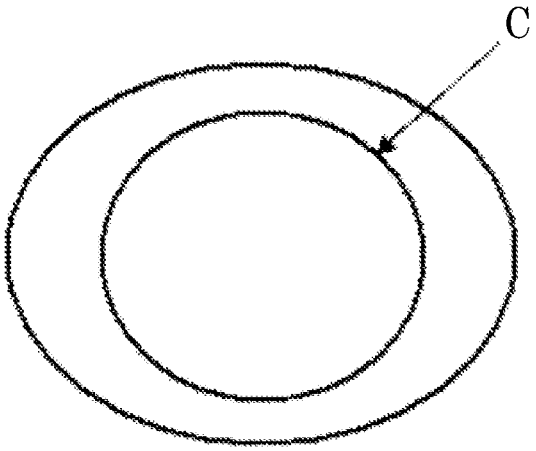
FIG. 7 is an explanatory view of an inner-diameter roundness in the present invention, where the inner-diameter roundness is denoted by C.

Furthermore, the term "inner-diameter roundness" in the present invention refers to a roundness of the inner shape as illustrated in FIG. 7, since a metal tube has a thickness.

[Metal Tube and Production Method Thereof]

The metal tube of the present invention is produced as follows. Specifically, extrusion is performed on a conductive metal material having a volume resistance of $10^{10}\Omega\cdot$cm or lower, such as aluminum, an aluminum alloy, stainless steel, nickel, chromium, Nichrome, copper, gold or platinum, followed by drawing such as pulling or ironing, and the resultant product is subjected to surface treatment such as cutting, honing or centerless processing.

In the present invention, mandrel extrusion is preferably employed.

The material is melted, refined and cast to form a billet, which is then extruded with a mandrel at a predetermined extrusion temperature. Notably, the billet is processed through, for example, direct extrusion or indirect extrusion.

The metal tube produced through mandrel extrusion has no seam, so that it has a high inner-diameter roundness.

In the subsequent processing, in many cases, the ends of the metal tube are held at the inner surface thereof. If the inner-diameter roundness is high, a metal tube having a high runout accuracy can be readily produced.

[Extrusion Step]

Figure 8A:
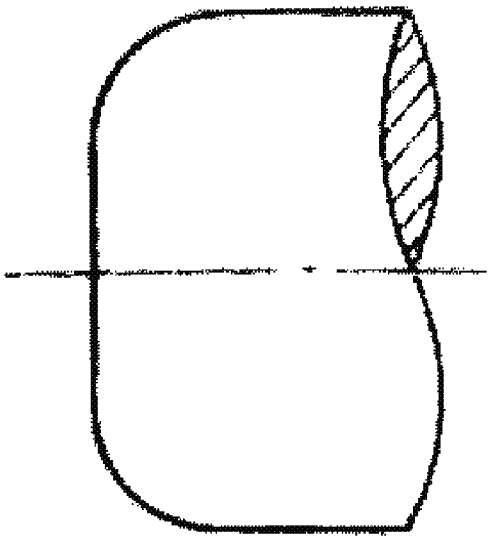
FIGS. 8A to 8C each illustrate the shape of the tip of a mandrel in the present invention.
Figure 8B:
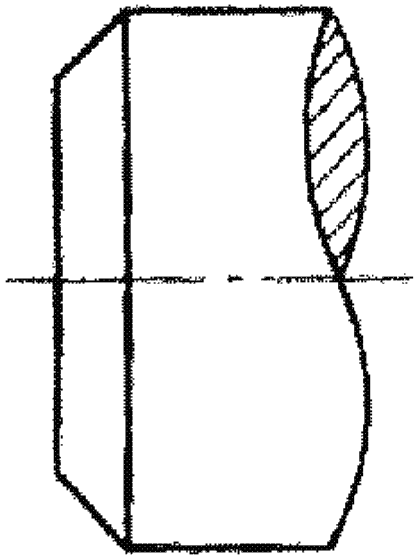
Figure 8C:
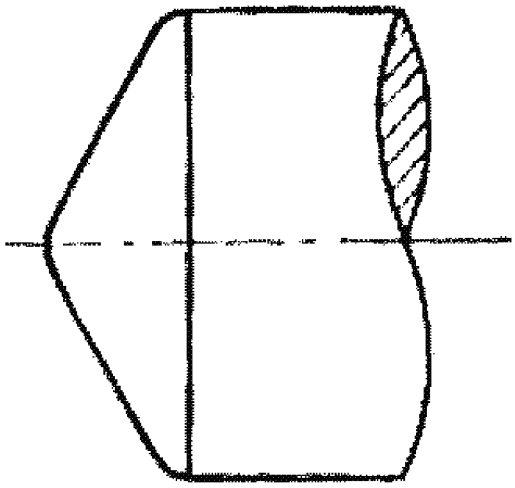

The extrusion step will next be described briefly. The tip of a mandrel preferably has a tapered shape as illustrated in FIGS. 8A to 8C, in order to avoid stress concentration during extrusion. Use of such a mandrel can produce a metal tube having good roundness, thickness deviation, total runout and squareness.

The mandrel having the shape illustrated in FIG. 8B was used in Examples described below in detail. Needless to say, the present invention is not construed as being limited thereto.

The surface layer of the billet is preferably removed before extrusion, since the billet surface layer generally has a segregation layer. As a result, extrusion is uniformly performed to attain good roundness, thickness deviation, total runout and squareness. Notably, the 2 mm-thick surface layer of the billet was removed through cutting in all the below Examples. The billet had a cylindrical shape. Needless to say, the billet may be a commercially available product.

In the first embodiment, when the metal tube processed through extrusion has an inner-diameter roundness of 5 μm to 50 mm, a certain degree of thickness deviation can be reduced by the subsequent processing.

Notably, in the first embodiment, the thickness deviation of the metal tube processed through extrusion is preferably 70 μm or lower, more preferably 60 μm or lower. Also, the total runout of the metal tube processed through extrusion is preferably 50 μm or lower.

Furthermore, in the first embodiment, the squareness of the metal tube processed through extrusion is preferably 100 μm or lower, more preferably 70 μm or lower.

In the second embodiment, when the metal tube processed through extrusion has an inner-diameter roundness of 10 μm to 70 mm, a certain degree of thickness deviation can be reduced by the subsequent processing.

Notably, in the second embodiment, the thickness deviation of the metal tube processed through extrusion is preferably 100 μm or lower, more preferably 80 μm or lower. Also, the total runout of the metal tube processed through extrusion is preferably 100 μm or lower.

Furthermore, in the second embodiment, the squareness of the metal tube processed through extrusion is preferably 150 μm or lower, more preferably 100 μm or lower.

The drawing processing is preformed through pulling or ironing to adjust the outer diameter, inner diameter and thickness.

The surface treatment is performed through cutting, honing or centerless processing.

[Photoconductor of the Present Invention, Image Forming Apparatus, Image Forming Method and Process Cartridge Using the Photoconductor]

Figure 1:
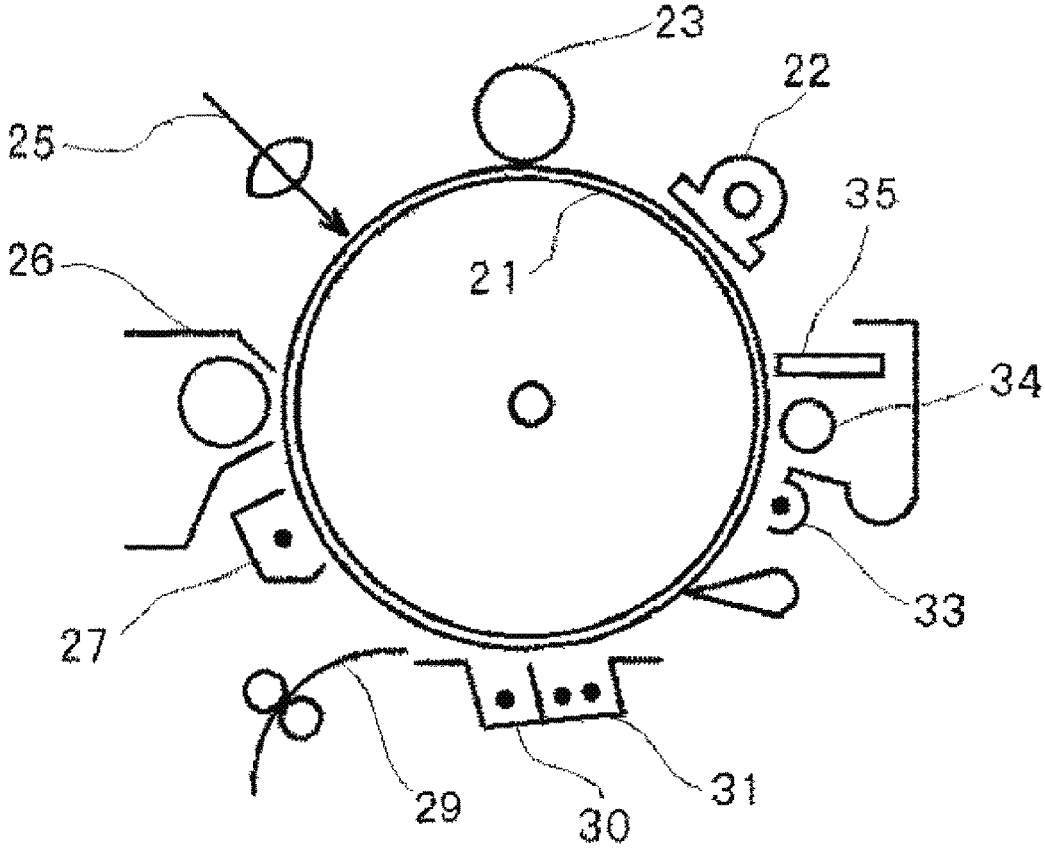
FIG. 1 is an explanatory schematic view of an image forming process and an image forming apparatus of the present invention.

An electrophotographic photoconductor of the present invention is used for image formation. While rotated, the electrophotographic photoconductor is subjected to necessary or intended treatments such as charging, latent image formation, developing and transferring with various units arranged therearound as illustrated in FIG. 1.

For achieving high image quality, it is necessary to perform each treatment uniformly on the entire electrophotographic photoconductor. The electrophotographic photoconductor is rotated during these treatments and thus, is required to have high runout accuracy.

The electrophotographic photoconductor of the present invention has a metal tube and a photoconductive layer thereon, and is provided with flanges at openings of both ends of the metal tube.

In order to meet the recent requirements of high-quality image formation, it has been found in the present invention that in the first embodiment, the metal tube is required to have an outer diameter of 40 mm to 150 mm as well as have a total runout of 5 μm to 50 μm relative to a driving axis thereof. When the total runout is lower than 5 μm, production cost may increase, whereas when the total runout is higher than 50 μm, inaccurate superposition of multicolor images may occur.

In order to meet the recent requirements of high-quality image formation, it has been found in the present invention that in the second embodiment, the metal tube is required to have an outer diameter of 150 mm to 300 mm as well as have a total runout of 10 μm to 100 μm relative to a driving axis thereof. When the total runout is lower than 10 μm, production cost may increase, whereas when the total runout is higher than 100 μm, inaccurate superposition of multicolor images may occur.

[Photoconductive Layer]

Next, the photoconductive layer of the present invention will be described.

If necessary, the photoconductive layer may have an intermediate layer, a charge generation layer, a charge transport layer and a protective layer.

<Regarding Intermediate Layer>

In the electrophotographic photoconductor of the present invention, an intermediate layer may be provided on the metal tube.

The intermediate layer is, for example, a layer in which a pigment is dispersed in a binder resin; or an oxide layer.

Examples of the binder resin include polyvinyl alcohols, casein, sodium polyacrylates, Nylon copolymers, methoxymethylated Nylon, polyurethanes, polyesters, polyamide resins, melamine resins, phenol resins, alkyd-melamine resins and epoxy resins.

Examples of the pigment include metal oxides such as titanium oxide, silica, alumina, zirconium oxide, tin oxide and indium oxide. These pigments may be subjected to surface treatments before use.

The intermediate layer preferably has a thickness of 0 μm to 5 μm.

<Regarding Charge Generation Layer and Charge Transport Layer>

The charge generation layer and the charge transport layer may be formed into a single layer structure containing a charge generating compound and a charge transporting compound. Alternatively, they may be separately provided to form a laminated structure. For convenience, the laminated structure will first be described.

—Charge Generation Layer—

The charge generation layer is a layer mainly containing a charge generating compound. The charge generating compound is not particularly limited and may be known materials such as phthalocyanine and azo.

The charge generation layer is formed as follows. Specifically, the charge generating compound is dispersed in an appropriate solvent using a bead mill or ultrasonic waves, optionally together with a binder resin; and the resultant dispersion liquid is applied and dried.

Examples of the binder resin optionally used in the charge generation layer include polyamides, polyurethanes, epoxy resins, polyketones, polycarbonates, silicone resins, acryl resins, polyvinylbutyrals, polyvinylformals, polyvinyl ketones, polystyrenes, polysulfones, poly-N-vinylcarbazols, polyacrylamides, polyvinyl benzals, polyesters, phenoxy resins, vinyl chloride-vinyl acetate copolymers, polyvinyl acetates, polyphenylene oxides, polyamides, polyvinyl pyridines, cellulose resins, casein, polyvinyl alcohols and polyvinyl pyrrolidones.

The amount of the binder resin is preferably 500 parts by mass or lower, more preferably 10 parts by mass to 300 parts by mass, per 100 parts by mass of the charge generating compound.

The charge generation layer preferably has a thickness of 0.01 μm to 5 μm, more preferably 0.1 μm to 2 μm.

—Charge Transport Layer—

The charge transport layer may be formed as follows. Specifically, a charge transporting compound and a binder resin are dissolved or dispersed in an appropriate solvent, and the resultant dispersion liquid is applied on the charge generation layer, followed by drying. If necessary, a plasticizer, a leveling agent, an anti-oxidant, etc. may be used additionally.

The charge transporting compound is classified into a hole transporting compound and an electron transporting compound.

Examples of the hole transporting compound include poly-N-vinylcarbazole or derivatives thereof, poly-γ-carbazolylethyl glutamate or derivatives thereof, pyrene-formaldehyde condensates or derivatives thereof, polyvinylenes, polyvinylphenanthrenes, polysilanes, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives and enamine derivatives. These may be used alone or in combination.

Examples of the electron transporting compound include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, 1,3,7-trinitrodibenzothiophene-5,5-dioxide and benzoquinone derivatives. These may be used alone or in combination.

Examples of the binder resin include polystyrenes, styrene-acrylonitrile copolymers, styrene-butadiene copolymers, styrene-maleic anhydride copolymers, polyesters, polyvinyl chloride, vinyl chloride-vinyl acetate copolymers, polyvinyl acetates, polyvinylidene chloride, polyarylates, phenoxy resins, polycarbonates, cellulose acetate resins, ethyl cellulose resins, polyvinyl butyrals, polyvinyl formals, polyvinyl toluenes, poly-N-vinylcarbazoles, acryl resins, silicone resins, epoxy resins, melamine resins, urethane resins, phenol resins and alkyd resins. These may be used alone or in combination.

The amount of the charge transporting compound is preferably 20 parts by mass to 300 parts by mass, more preferably 40 parts by mass to 150 parts by mass, per 100 parts by mass of the binder resin.

The charge transport layer preferably has a thickness of 5 μm to 100 μm.

Also, a polymeric charge transporting compound is preferably used in the charge transport layer, which has functions of both the charge transporting compound and the binder resin. The charge transport layer made of the polymeric charge transporting compound is excellent in abrasion resistance. The polymeric charge transporting compound may be known materials. In particular, preferred are polycarbonates having a triarylamine structure as the main or side chain thereof.

Also, in addition to the above polymeric charge transporting compounds, the polymeric charge transporting compound used for the charge transport layer may be produced as follows. Specifically, a monomer or oligomer having an electron-donating group is allowed to exist during formation of the charge transport layer, and after the formation of the charge transport layer, the monomer or oligomer is cured or crosslinked to finally obtain a polymer having a two- or three-dimensionally crosslinked structure.

Also, it is quite advantageous to use a monomer having a charge transporting property as all or part of the above reactive monomer. Use of such a monomer can form charge-transporting sites in the network structure, enabling the resultant charge transport layer to satisfactorily exhibit its functions. The monomer having a charge transporting property advantageously used is a reactive monomer having a triarylamine structure.

The polymer having an electron-donating group is, for example, a copolymer, a block polymer, a graft polymer, a star polymer, each being formed of known monomers, and crosslinked polymers having an electron-donating group as disclosed in JP-A Nos. 03-109406, 2000-206723 and 2001-34001.

The above description relates to the laminated structure, but in the present invention, the single layer structure may also be employed. The single layer structure is a single layer containing at least the above charge generating compound and the binder resin. The binder resin usable is preferably those mentioned in relation to the charge generation layer or charge transport layer. Also, use of a charge transporting compound in combination is preferred from the viewpoints of attaining high photosensitivity, high carrier transporting property and low residual potential. The charge transporting compound used is selected from a hole transporting compound and an electron transporting compound depending on which polarity the electrophotographic photoconductor surface is charged with. Furthermore, the above-described polymeric charge transporting compound, having the functions of the binder resin and the charge transporting compound, is preferably used for the single-layered photoconductive layer.

<Protective Layer>

The electrophotographic photoconductor of the present invention may be provided with a protective layer for improving its durability.

The protective layer may be a resin film, but is preferably a crosslinked resin film.

Examples of the crosslinked resin include those obtained by curing radical polymerizable monomers.

Examples of the monomers include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexylacrylate, isoamyl acrylate, isobutyl acrylate, methoxytriethylene glycol acrylate, phenoxytetraethylene glycol acrylate, cetyl acrylate, isostearyl acrylate, stearyl acrylate, styrene monomer, 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacrylate, neopentyl glycol diacrylate, Bisphenol A-EO modified diacrylate, Bisphenol F-EO modified diacrylate, neopentyl glycol diacrylate, trimethylolpropane triacrylate (TMPTA), trimethylolpropane trimethacrylate, trimethylolpropane alkylene modified triacrylate, trimethylolpropane ethyleneoxy modified (hereinafter referred to as "EO modified") triacrylate, trimethylolpropane propyleneoxy modified (hereinafter referred to as "PO modified") triacrylate, trimethylolpropane caprolactone modified triacrylate, trimethylolpropane alkylene modified trimethacrylate, pentaerythritol triacrylate, pentaerythritol tetraacrylate (PETTA), glycerol triacrylate, glycerol epichlorohydrin modified (hereinafter referred to as "ECH modified") triacrylate, glycerol EO modified triacrylate, glycerol PO modified triacrylate, tris (acryloxyethyl) isocyanurate, dipentaerythritol hexaacrylate (DPHA), dipentaerythritol caprolactone modified hexaacrylate, dipentaerythritol hydroxypentaacrylate, alkylated dipentaerythritol pentaacrylate, alkylated dipentaerythritol tetraacrylate, alkylated dipentaerythritol triacrylate, dimethylolpropane tetraacrylate (DTMPTA), pentaerythritol ethoxytetraacrylate, phosphoric acid EO modified triacrylate and 2,2,5,5-tetrahydroxymethyl cyclopentanone tetraacrylate. These may be used alone or in combination.

Furthermore, incorporation of a filler into the protective layer can improve durability thereof.

Examples of the filler usable in the protective layer include fine silicone resin particles, fine alumina particles, fine silica particles, fine titanium oxide particles, DLC, fine non-crystalline carbon particles, fine fullerene particles, colloidal silica, conductive particles (e.g., zinc oxide, titanium oxide, tin oxide, antimony oxide, indium oxide, bismuth oxide, tin-doped indium oxide, antimony-doped tin oxide and antimony-doped zirconium oxide).

Moreover, the above-described charge transporting compound can be incorporated into the protective layer to obtain excellent electrical properties.

The protective layer preferably has a thickness of 2 μm to 15 μm.

<Regarding Provision of Flanges>

The metal tube is provided at openings of both ends thereof with flanges for retaining/driving, to thereby form an electrophotographic photoconductor.

Provision of flanges may be performed before or after the formation of the photoconductive layer.

The flange preferably has a total runout of 20 μm or lower, more preferably 10 μm or lower.

(Image Forming Method and Apparatus)

Next, the image forming apparatus of the present invention will be described in detail with reference to the drawings.

FIG. 1 schematically illustrates an image forming process and an image forming apparatus of the present invention. The below-described modification examples are also within the scope of the present invention.

In FIG. 1, an electrophotographic photoconductor 21 has a metal tube and at least a photoconductive layer provided on the metal tube. A charging roller 23, a pre-transfer charger 27, a transfer charger 30, a separation charger 31 and a pre-cleaning charger 33 are known units including a corotron, a scorotron, a solid state charger, a charging roller and a transfer roller.

Among charging methods using these chargers, preferred are a contact charging method or a charging method in which the charger is provided proximately to the photoconductor in a non-contact manner. The contact charging method is advantageous in, for example, that charging efficiency is high and that the amount of ozone generated is smaller.

Here, the charging member used in the contact charging method is a charging member whose surface is brought into contact with the electrophotographic photoconductor surface, and is a charging roller, a charging blade or a charging brush. Of these, a charging roller or a charging brush is preferably used.

Also, the charging member provided proximately to the photoconductor is a charging member provided proximately to the photoconductor in a non-contact manner so that a space (gap) of 200 μm or less is formed between the electrophotographic photoconductor surface and the charging member surface.

Figure 2:
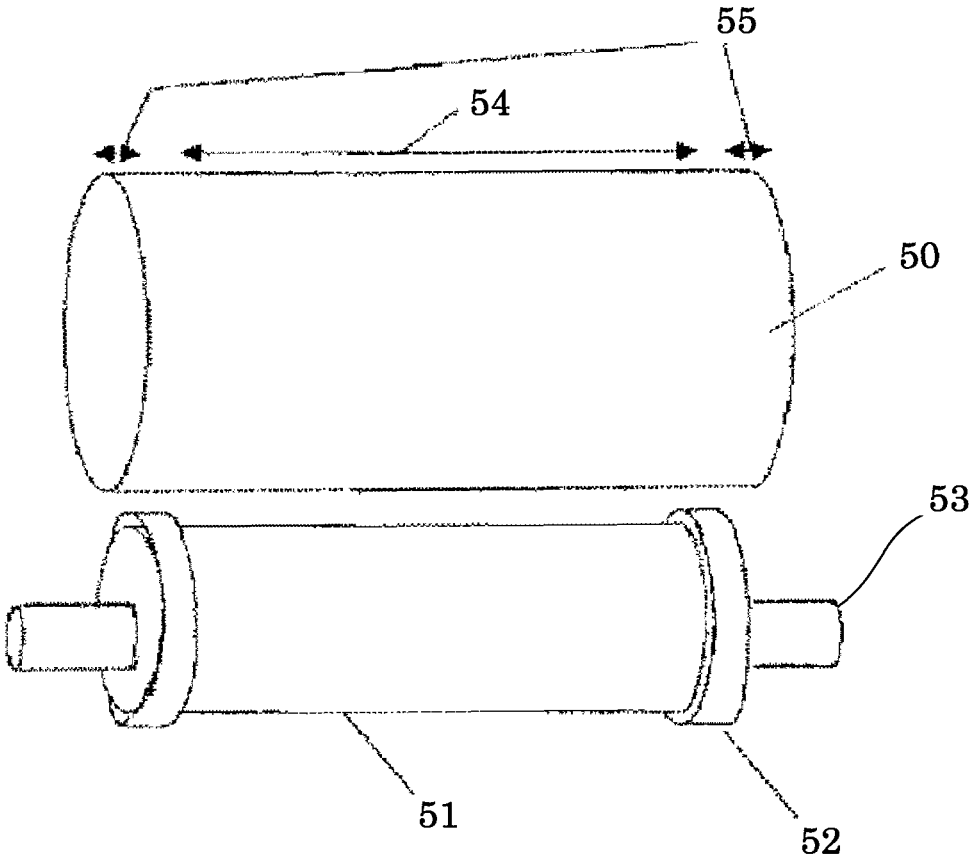
FIG. 2 schematically illustrates a proximately charging mechanism in which a charging member is provided proximately to a surface of an electrophotographic photoconductor.

This charging member is different from known chargers such as a corotron and a scorotron in terms of the gap size. The proximately provided charging member used in the present invention may have any shape, so long as it can appropriately control the gap with respect to the electrophotographic photoconductor surface. For example, the rotary shafts of the electrophotographic photoconductor and the charging member are mechanically fixed so as to form an appropriate gap. In particular, gap-forming members are disposed at both ends of the non-image forming region of a charging roller serving as a charging member, and only the gap-forming members are brought into contact with the electrophotographic photoconductor surface, so that the image forming region of the electrophotographic photoconductor is disposed with respect to the charging member surface in a non-contact manner. Alternatively, gap-forming members are disposed at both ends of the non-image forming region of an electrophotographic photoconductor, and only the gap-forming members are brought into contact with the charging member surface, so that the image forming region of the electrophotographic photoconductor is disposed with respect to the charging member surface in a non-contact manner. These methods are simple methods capable of maintaining the gap stably. In particular, the methods described in JP-A Nos. 2002-148904 and 2002-148905 are preferably employed. FIG. 2 illustrates a proximately charging mechanism in which a charging member having gap-forming members is provided proximately to a surface of an electrophotographic photoconductor. In FIG. 2, reference numeral 50 denotes an electrophotographic photoconductor, reference numeral 51 denotes a charging roller, reference numeral 52 denotes a gap-forming member, reference numeral 53 denotes a rotary shaft of the charging roller, reference numeral 54 denotes an image forming region and reference numeral 55 denotes non-image forming regions. The above method is advantageously employed since charging efficiency is high, the amount of ozone generated is smaller, no staining due to toner, etc. occurs, and no mechanical abrasion due to contact occurs. In addition, the AC superposition method may be advantageously employed for current application, since uneven charging does not easily occur.

When using such a charging member used in a contact or non-contact manner, uniform contact or gap cannot be attained in an electrophotographic photoconductor poor in runout accuracy. However, since the electrophotographic photoconductor of the present invention has good runout accuracy, the effects of attaining uniform contact or gap can be obtained.

An image exposing section 25 may be a light-emitting diode (LED), a laser diode (LD), an electroluminescence (EL) device, etc. capable of ensuring high brightness.

A light source used for a charge-eliminating lamp 22 may be a usual light-emitting device such as a fluorescent lamp, a tungsten lamp, a halogen lamp, a mercury lamp, a sodium lamp, a light-emitting diode (LED), a laser diode (LD) or an electroluminescence (EL) device. Also, a filter may be used for applying light having a desired wavelength. The filter may be various filters such as sharp-cut filter, a band-pass filter, an infrared cut filter, a dichroic filter, an interference filter and a color conversion filter.

Toner particles are transferred onto an electrophotographic photoconductor 21 by a developing unit 26, and then the toner particles are transferred onto a recording medium 29. After transfer, some toner particles remain on the electrophotographic photoconductor 21. Such residual toner particles are removed from the electrophotographic photoconductor with a fur brush 34 or a blade 35. The cleaning is performed with a cleaning brush only in some cases. The cleaning brush may be a known brush such as a fur brush or a magfur brush.

An electophotographic photoconductor is provided with positive (negative) charges, and then the electophotographic photoconductor is subjected to imagewise light exposure, whereby a positive (negative) electrostatic latent image is formed thereon. When the positive (negative) electrostatic latent image is developed using negatively (positively) charged toner particles (charge-detecting microparticles), a positive image is obtained, whereas when the positive (negative) electrostatic latent image is developed using positively (negatively) charged toner particles, a negative image is obtained. As described above, the developing unit and the charge-eliminating unit may employ a known method.

The above-described image forming units may be fixed in a copier, facsimile or printer; or may be mounted therein in the form of a process cartridge. The process cartridge is a single device (part) including an electrophotographic photoconductor as well as a charging unit, an exposing unit, a developing unit, a transfer unit, a cleaning unit, a charge-eliminating unit, etc.

Figure 3:
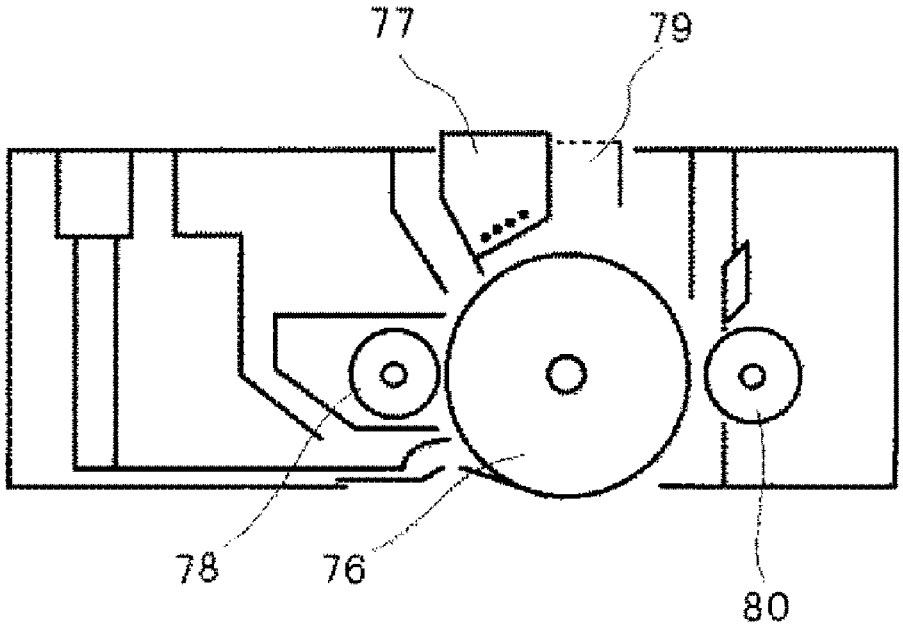
FIG. 3 is a schematic view of one exemplary process cartridge of the present invention.

The shape of the process cartridge is varied, but is in general as illustrated in FIG. 3, for example. In FIG. 3, reference numeral 76 denotes a photoconductor, reference numeral 78 denotes a developing roller, reference numeral 77 denotes a charging unit, reference numeral 79 denotes an exposing unit and reference numeral 80 denotes a cleaning unit.

EXAMPLES

The present invention will next be described in detail by way of Examples, which should not be construed as limiting the present invention thereto. Notably, the unit "part(s)" means "parts by mass" in Examples.

Example A1

A material for JIS1050 aluminum alloy was melted (in a non-oxidative environment), refined and cast to form a billet.

Thereafter, indirect extrusion was performed with a mandrel being passed through the billet, to thereby produce an extruded tube. The extruded tube was found to have an inner-diameter roundness of 5 μm, a thickness deviation of 9 μm, a total runout of 25 μm, and a squareness of 18 μm.

The extruded tube was drawn and cut to produce an aluminum cylinder having an outer diameter of 40.2 mm, an inner diameter of 38 mm, and a length of 340 mm.

Figure 4:
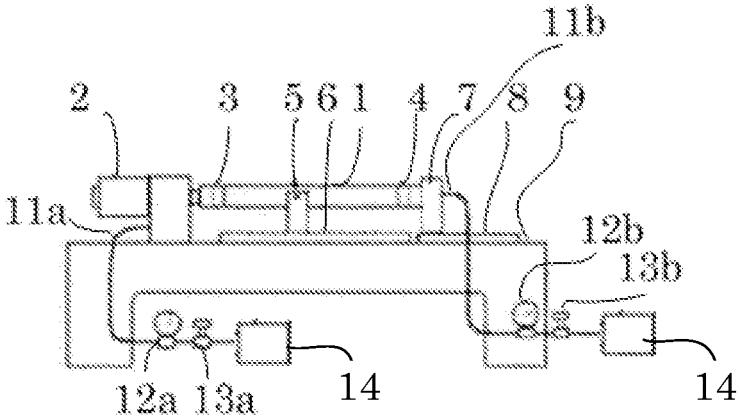
FIG. 4 illustrates a precision lathe used for cutting in Examples of the present invention.

The thus-produced aluminum cylinder was set in a precision lathe illustrated in FIG. 4. While being held at the inner surface with balloon chucks 3 and 4 and a damper 7 serving as a tailstock, the crude tube (aluminum cylinder) 1 was cut with a tool post 5 moved along the cylinder 1 (processing target) by a tool post moving mechanism 6, to thereby produce a metal tube having an outer diameter of 40 mm. In FIG. 4, reference numeral 2 denotes a motor driving a main spindle, reference numeral 3 denotes a balloon chuck at the side of the main spindle, reference numeral 4 denotes a balloon chuck at the side opposite to the main spindle, reference numeral 8 denotes a tailstock moving mechanism, reference numeral 9 denotes a base of the lathe, reference numeral 11*a* denotes a pressurized gas-feeding tube for the balloon chuck 3 at the side of the main spindle, reference numeral 11*b* denotes a pressurized gas-feeding tube for the balloon chuck 4 at the side opposite to the main spindle, reference numerals 12*a* and 12*b* each denote a pressure meter, reference numerals 13*a* and 13*b* each denote an electromagnetic valve, and reference numeral 14 denotes a pressurized gas-feeding source.

Subsequently, the metal tube was coated with the intermediate layer-coating liquid having the following composition, followed by drying at 130° C. for 20 min, to thereby form an intermediate layer having a thickness of about 3.5 μm. Then, the intermediate layer was coated with a charge generation layer-coating liquid having the following composition, followed by drying at 130° C. for 20 min, to thereby form a charge generation layer having a thickness of about 0.2 μm. Furthermore, the charge generation layer was coated with a charge transport layer-coating liquid having the following composition, followed by drying at 130° C. for 20 min, to thereby form a charge transport layer having a thickness of about 30 μm. The resultant metal tube was provided with flanges each having a total runout of 4 μm to produce an electrophotographic photoconductor A1.

—Intermediate Layer-Coating Liquid—

Titanium oxide CR-EL (product of ISHIHARA SANGYO KAISHA, LTD.): 50 parts

Alkyd resin BECKOLITE M6401-50: 15 parts
(solid content: 50% by mass, product of DIC Corporation)

Melamine resin L-145-60: 8 parts
(solid content: 60% by mass, product of DIC Corporation)

2-Butanone: 120 parts

—Charge Generation Layer-Coating Liquid—

Asymmetric bisazo pigment having the following structural formula: 2.5 parts

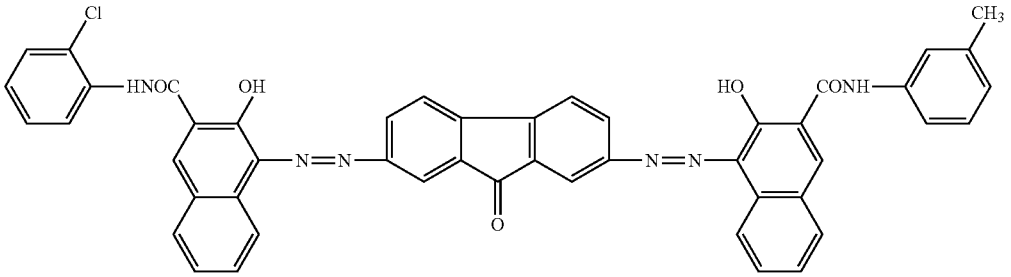

Polyvinyl butyral ("XYHL," product of UCC): 0.5 parts

Methyl ethyl ketone: 110 parts

Cyclohexanone: 260 parts

—Charge Transport Layer-Coating Liquid—

Polycarbonate Z POLYCA (product of Teijin Chemicals Ltd.): 10 parts

Charge transporting compound having the following structural formula: 7 parts

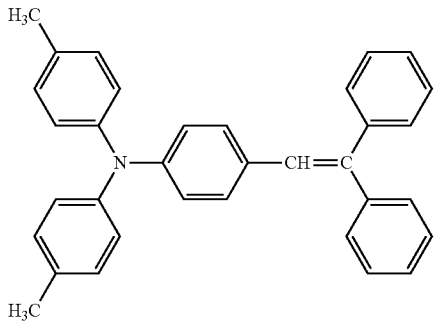

Tetrahydrofuran: 80 parts
Silicone oil: 0.002 parts
(KF50-100cs, product of Shin-Etsu Chemical Co., Ltd.)

Example A2

A material for JIS1050 aluminum alloy was melted, refined and cast to form a billet.

Thereafter, indirect extrusion was performed with a mandrel being passed through the billet, to thereby produce an extruded tube. The extruded tube was found to have an inner-diameter roundness of 15 μm, a thickness deviation of 24 μm, a total runout of 30 μm, and a squareness of 37 μm.

The extruded tube was drawn and cut to produce an aluminum cylinder having an outer diameter of 60.2 mm, an inner diameter of 58 mm, and a length of 340 mm.

The thus-produced aluminum cylinder was set in a precision lathe illustrated in FIG. 4. While being held at the inner surface with balloon chucks and a damper, the aluminum cylinder was cut to produce a metal tube having an outer diameter of 60 mm.

Then, the metal tube was provided with an intermediate layer, a charge generation layer and a charge transport layer in the same manner as in Example A1. Furthermore, the resultant metal tube was provided with flanges each having a total runout of 10 μm to produce an electrophotographic photoconductor A2.

Example A3

A material for JIS1050 aluminum alloy was melted, refined and cast to form a billet.

Thereafter, indirect extrusion was performed with a mandrel being passed through the billet, to thereby produce an extruded tube. The extruded tube was found to have an inner-diameter roundness of 23 μm, a thickness deviation of 32 μm, a total runout of 36 μm, and a squareness of 51 μm.

The extruded tube was drawn and cut to produce an aluminum cylinder having an outer diameter of 100.2 mm, an inner diameter of 98 mm, and a length of 380 mm.

The thus-produced aluminum cylinder was set in a precision lathe illustrated in FIG. 4. While being held at the inner surface with balloon chucks and a damper, the aluminum cylinder was cut to produce a metal tube having an outer diameter of 100 mm.

Then, the metal tube was provided with an intermediate layer, a charge generation layer and a charge transport layer in the same manner as in Example A1. Furthermore, the resultant metal tube was provided with flanges each having a total runout of 16 μm to produce an electrophotographic photoconductor A3.

Example A4

A material for JIS1050 aluminum alloy was melted, refined and cast to form a billet.

Thereafter, indirect extrusion was performed with a mandrel being passed through the billet, to thereby produce an extruded tube. The extruded tube was found to have an inner-diameter roundness of 38 μm, a thickness deviation of 51 μm, a total runout of 43 μm, and a squareness of 76 μm.

The extruded tube was drawn and cut to produce an aluminum cylinder having an outer diameter of 120.2 mm, an inner diameter of 118 mm, and a length of 380 mm.

The thus-produced aluminum cylinder was set in a precision lathe illustrated in FIG. 4. While being held at the inner surface with balloon chucks and a damper, the aluminum cylinder was cut to produce a metal tube having an outer diameter of 120 mm.

Then, the metal tube was provided with an intermediate layer, a charge generation layer and a charge transport layer in the same manner as in Example A1. Furthermore, the resultant metal tube was provided with flanges each having a total runout of 18 μm to produce an electrophotographic photoconductor A4.

Example A5

A material for JIS1050 aluminum alloy was melted, refined and cast to form a billet.

Thereafter, indirect extrusion was performed with a mandrel being passed through the billet, to thereby produce an extruded tube. The extruded tube was found to have an inner-diameter roundness of 50 μm, a thickness deviation of 70 μm, a total runout of 50 μm, and a squareness of 100 μm.

The extruded tube was drawn and cut to produce an aluminum cylinder having an outer diameter of 150.2 mm, an inner diameter of 148 mm, and a length of 380 mm.

The thus-produced aluminum cylinder was set in a precision lathe illustrated in FIG. 4. While being held at the inner surface with balloon chucks and a damper, the aluminum cylinder was cut to produce a metal tube having an outer diameter of 150 mm.

Then, the metal tube was provided with an intermediate layer, a charge generation layer and a charge transport layer in the same manner as in Example A1. Furthermore, the resultant metal tube was provided with flanges each having a total runout of 20 μm to produce an electrophotographic photoconductor A5.

Comparative Example A1

A material for JIS1050 aluminum alloy was melted, refined and cast to form a billet.

Thereafter, through porthole extrusion, an extruded tube was produced. The extruded tube was found to have an inner-diameter roundness of 51 μm, a thickness deviation of 73 μm, a total runout of 54 μm, and a squareness of 102 μm.

The extruded tube was drawn and cut to produce an aluminum cylinder having an outer diameter of 40.2 mm, an inner diameter of 38 mm, and a length of 340 mm. The thus-produced aluminum cylinder was set in a precision lathe illustrated in FIG. 4. While being held at the inner surface with balloon chucks and a damper, the aluminum cylinder was cut to produce a metal tube having an outer diameter of 40 mm.

Then, the metal tube was provided with an intermediate layer, a charge generation layer and a charge transport layer in the same manner as in Example A1. Furthermore, the resultant metal tube was provided with flanges each having a total runout of 4 μm to produce an electrophotographic photoconductor A6.

Comparative Example A2

A material for JIS1050 aluminum alloy was melted, refined and cast to form a billet.

Thereafter, through porthole extrusion, an extruded tube was produced. The extruded tube was found to have an inner-diameter roundness of 102 μm, a thickness deviation of 160 μm, a total runout of 103 μm, and a squareness of 155 μm.

The extruded tube was drawn and cut to produce an aluminum cylinder having an outer diameter of 150.2 mm, an inner diameter of 148 mm, and a length of 380 mm. The thus-produced aluminum cylinder was set in a precision lathe illustrated in FIG. 4. While being held at the inner surface with balloon chucks and a damper, the aluminum cylinder was cut to produce a metal tube having an outer diameter of 150 mm.

Then, the metal tube was provided with an intermediate layer, a charge generation layer and a charge transport layer in the same manner as in Example A1. Furthermore, the resultant metal tube was provided with flanges each having a total runout of 20 μm to produce an electrophotographic photoconductor A7.

Comparative Example A3

A material for JIS1050 aluminum alloy was melted, refined and cast to form a billet.

Thereafter, through porthole extrusion, an extruded tube was produced. The extruded tube was found to have an inner-diameter roundness of 51 μm, a thickness deviation of 71 μm, a total runout of 52 μm, and a squareness of 101 μm.

The extruded tube was drawn and cut to produce an aluminum cylinder having an outer diameter of 30.2 mm, an inner diameter of 28 mm, and a length of 340 mm. The thus-produced aluminum cylinder was set in a precision lathe illustrated in FIG. 4. While being held at the inner surface with balloon chucks and a damper, the aluminum cylinder was cut to produce a metal tube having an outer diameter of 30 mm.

Then, the metal tube was provided with an intermediate layer, a charge generation layer and a charge transport layer in the same manner as in Example A1. Furthermore, the resultant metal tube was provided with flanges each having a total runout of 4 μm to produce an electrophotographic photoconductor A8.

The inner-diameter roundness, thickness deviation and squareness were measured with a roundness meter ROND-COM 60A (product of TOKYO SEIMITSU CO., LTD.).

The total runout of each of the extruded tube, metal tube and electrophotographic photoconductor was measured with a runout meter (product of Ricoh Company, Ltd.).

The total runout of the flange was measured with a test indicator (product of Mitutoyo Corporation).

Each of the above-produced electrophotographic photoconductors A1 to A8 was measured for total runout accuracy.

Further, each of electrophotographic photoconductors A1 to A8 was mounted to an image forming apparatus illustrated in FIG. 1. The image forming apparatus was caused to output ISO/JIS-SCID image N1 (portrait), which was then evaluated for color reproducibility. Note that the color reproducibility was ranked as 5, 4, 3, 2 or 1 where the higher the rank, the better the color reproducibility. The results are shown in Table 1. In this table, the ranks in the column of image evaluation are based on the following evaluation criteria.

[Evaluation Criteria]

5: Color reproducibility was extremely good; i.e., even when enlarged with a loupe, the image was found to be highly definite and have no color shift.

4: Color reproducibility was considerably good.

3: Color reproducibility was good; i.e., when observed with the naked eyes, the image was found to have no areas poor in color reproducibility.

2: When carefully observed with the naked eyes, the image was found to have areas poor in color reproducibility.

1: When observed with the naked eyes, the image was found to have areas poor in color reproducibility.

TABLE A1

| | | Outer diameter (mm) | Runout (μm) | Image evaluation |
|---|---|---|---|---|
| Electrophotographic photoconductor A1 | Ex. A1 | 40 | 25 | 5 |
| Electrophotographic photoconductor A2 | Ex. A2 | 60 | 30 | 4 |
| Electrophotographic photoconductor A3 | Ex. A3 | 100 | 36 | 5 |
| Electrophotographic photoconductor A4 | Ex. A4 | 120 | 42 | 4 |
| Electrophotographic photoconductor A5 | Ex. A5 | 150 | 50 | 5 |
| Electrophotographic photoconductor A6 | Comp. Ex. A1 | 40 | 54 | 2 |
| Electrophotographic photoconductor A7 | Comp. Ex. A2 | 150 | 103 | 2 |
| Electrophotographic photoconductor A8 | Comp. Ex. A3 | 30 | 52 | 2 |

Example B1

A material for JIS1050 aluminum alloy was melted (in a non-oxidative environment), refined and cast to form a billet.

Thereafter, indirect extrusion was performed with a mandrel being passed through the billet, to thereby produce an extruded tube. The extruded tube was found to have an inner-diameter roundness of 10 μm, a thickness deviation of 36 μm, a total runout of 38 μm, and a squareness of 58 μm.

The extruded tube was drawn and cut to produce an aluminum cylinder having an outer diameter of 150.2 mm, an inner diameter of 148 mm, and a length of 530 mm.

The thus-produced aluminum cylinder was set in a precision lathe illustrated in FIG. 4. While being held at the inner surface with balloon chucks 3 and 4 and a damper 7 serving as a tailstock, the crude tube (aluminum cylinder) 1 was cut with a tool post 5 moved along the cylinder 1 (processing target) by a tool post moving mechanism 8, to thereby produce a metal tube having an outer diameter of 150 mm. In FIG. 4, reference numeral 2 denotes a motor driving a main spindle, reference numeral 3 denotes a balloon chuck at the side of the main spindle, reference numeral 4 denotes a balloon chuck at the side opposite to the main spindle, reference numeral 8 denotes a tailstock moving mechanism, reference numeral 9 denotes a base of the lathe, reference numeral 11*a* denotes a pressurized gas-feeding tube for the balloon chuck 3 at the side of the main spindle, reference numeral 11*b* denotes a pressurized gas-feeding tube for the balloon chuck 4 at the side opposite to the main spindle, reference numerals 12*a* and 12*b* each denote a pressure meter, reference numerals 13*a* and 13*b* each denote an electromagnetic valve, and reference numeral 14 denotes a pressurized gas-feeding source.

Subsequently, the metal tube was coated with the intermediate layer-coating liquid having the following composition, followed by drying at 130° C. for 20 min, to thereby form an intermediate layer having a thickness of about 3.5 μm. Then, the intermediate layer was coated with a charge generation layer-coating liquid having the following composition, followed by drying at 130° C. for 20 min, to thereby form a charge generation layer having a thickness of about 0.2 μm. Furthermore, the charge generation layer was coated with a charge transport layer-coating liquid having the following composition, followed by drying at 130° C. for 20 min, to thereby form a charge transport layer having a thickness of about 30 μm. The resultant metal tube was provided with flanges each having a total runout of 8 μm to produce an electrophotographic photoconductor B1.

—Intermediate Layer-Coating Liquid—

Titanium oxide CR-EL (product of ISHIHARA SANGYO KAISHA, LTD.): 50 parts

Alkyd resin BECKOLITE M6401-50: 15 parts (solid content: 50% by mass, product of DIC Corporation)

Melamine resin L-145-60: 8 parts (solid content: 60% by mass, product of DIC Corporation)

2-Butanone: 120 parts

—Charge Generation Layer-Coating Liquid—

Asymmetric bisazo pigment having the following structural formula: 2.5 parts

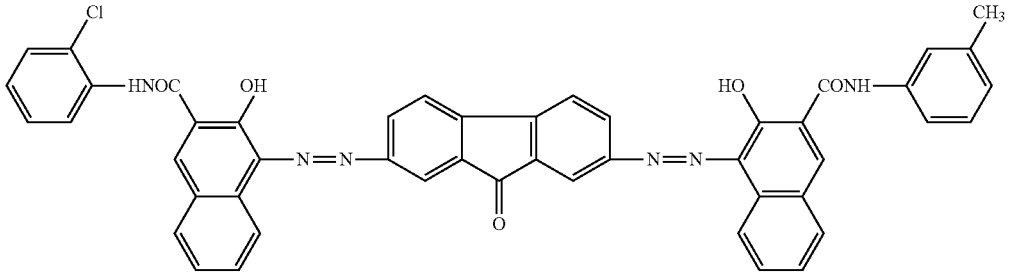

Polyvinyl butyral ("XYHL," product of UCC): 0.5 parts

Methyl ethyl ketone: 100 parts

Cyclohexanone: 260 parts

—Charge Transport Layer-Coating Liquid—

Polycarbonate Z POLYCA (product of Teijin Chemicals Ltd.): 10 parts

Charge transporting compound having the following structural formula: 7 parts

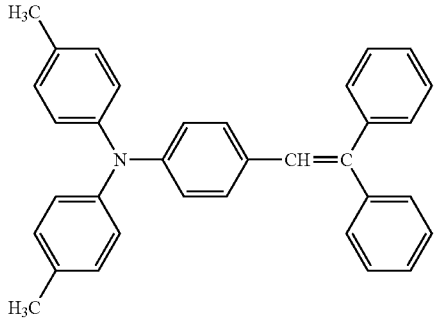

Tetrahydrofuran: 80 parts

Silicone oil: 0.002 parts (KF50-100cs, product of Shin-Etsu Chemical Co., Ltd.)

Example B2

A material for JIS1050 aluminum alloy was melted, refined and cast to form a billet.

Thereafter, indirect extrusion was performed with a mandrel being passed through the billet, to thereby produce an extruded tube. The extruded tube was found to have an inner-diameter roundness of 29 μm, a thickness deviation of 61 μm, a total runout of 59 μm, and a squareness of 78 μm.

The extruded tube was drawn and cut to produce an aluminum cylinder having an outer diameter of 200.2 mm, an inner diameter of 118 mm, and a length of 530 mm.

The thus-produced aluminum cylinder was set in a precision lathe illustrated in FIG. 4. While being held at the inner surface with balloon chucks and a damper, the aluminum cylinder was cut to produce a metal tube having an outer diameter of 200 mm.

Then, the metal tube was provided with an intermediate layer, a charge generation layer and a charge transport layer in the same manner as in Example B1. Furthermore, the resultant metal tube was provided with flanges each having a total runout of 13 μm to produce an electrophotographic photoconductor B2.

Example B3

A material for JIS1050 aluminum alloy was melted, refined and cast to form a billet.

Thereafter, indirect extrusion was performed with a mandrel being passed through the billet, to thereby produce an extruded tube. The extruded tube was found to have an inner-diameter roundness of 53 μm, a thickness deviation of 83 μm, a total runout of 77 μm, and a squareness of 102 μm.

The extruded tube was drawn and cut to produce an aluminum cylinder having an outer diameter of 250.2 mm, an inner diameter of 248 mm, and a length of 530 mm.

The thus-produced aluminum cylinder was set in a precision lathe illustrated in FIG. 4. While being held at the inner surface with balloon chucks and a damper, the aluminum cylinder was cut to produce a metal tube having an outer diameter of 250 mm.

Then, the metal tube was provided with an intermediate layer, a charge generation layer and a charge transport layer in the same manner as in Example B1. Furthermore, the resultant metal tube was provided with flanges each having a total runout of 22 μm to produce an electrophotographic photoconductor B3.

Example B4

A material for JIS1050 aluminum alloy was melted, refined and cast to form a billet.

Thereafter, indirect extrusion was performed with a mandrel being passed through the billet, to thereby produce an extruded tube. The extruded tube was found to have an inner-diameter roundness of 70 μm, a thickness deviation of 100 μm, a total runout of 100 μm, and a squareness of 150 μm.

The extruded tube was drawn and cut to produce an aluminum cylinder having an outer diameter of 300.2 mm, an inner diameter of 298 mm, and a length of 530 mm.

The thus-produced aluminum cylinder was set in a precision lathe illustrated in FIG. 4. While being held at the inner surface with balloon chucks and a damper, the aluminum cylinder was cut to produce a metal tube having an outer diameter of 300 mm.

Then, the metal tube was provided with an intermediate layer, a charge generation layer and a charge transport layer in the same manner as in Example B1. Furthermore, the resultant metal tube was provided with flanges each having a total runout of 30 μm to produce an electrophotographic photoconductor B4.

Comparative Example B1

A material for JIS1050 aluminum alloy was melted, refined and cast to form a billet.

Thereafter, through porthole extrusion, an extruded tube was produced. The extruded tube was found to have an inner-diameter roundness of 71 μm, a thickness deviation of 101 μm, a total runout of 101 μm, and a squareness of 151 μm.

The extruded tube was drawn and cut to produce an aluminum cylinder having an outer diameter of 150.2 mm, an inner diameter of 148 mm, and a length of 530 mm. The thus-produced aluminum cylinder was set in a precision lathe illustrated in FIG. 4. While being held at the inner surface with balloon chucks and a damper, the aluminum cylinder was cut to produce a metal tube having an outer diameter of 150 mm.

Then, the metal tube was provided with an intermediate layer, a charge generation layer and a charge transport layer in the same manner as in Example B1. Furthermore, the resultant metal tube was provided with flanges each having a total runout of 8 μm to produce an electrophotographic photoconductor B5.

Comparative Example B2

A material for JIS1050 aluminum alloy was melted, refined and cast to form a billet.

Thereafter, through porthole extrusion, an extruded tube was produced. The extruded tube was found to have an inner-diameter roundness of 102 μm, a thickness deviation of 160 μm, a total runout of 114 μm, and a squareness of 173 μm.

The extruded tube was drawn and cut to produce an aluminum cylinder having an outer diameter of 300.2 mm, an inner diameter of 298 mm, and a length of 530 mm. The thus-produced aluminum cylinder was set in a precision lathe illustrated in FIG. 4. While being held at the inner surface with balloon chucks and a damper, the aluminum cylinder was cut to produce a metal tube having an outer diameter of 300 mm.

Then, the metal tube was provided with an intermediate layer, a charge generation layer and a charge transport layer in the same manner as in Example B1. Furthermore, the resultant metal tube was provided with flanges each having a total runout of 30 μm to produce an electrophotographic photoconductor B6.

Comparative Example B3

A material for JIS1050 aluminum alloy was melted, refined and cast to form a billet.

Thereafter, through porthole extrusion, an extruded tube was produced. The extruded tube was found to have an inner-diameter roundness of 111 μm, a thickness deviation of 163 μm, a total runout of 117 μm, and a squareness of 183 μm.

The extruded tube was drawn and cut to produce an aluminum cylinder having an outer diameter of 310.2 mm, an inner diameter of 308 mm, and a length of 530 mm. The thus-produced aluminum cylinder was set in a precision lathe illustrated in FIG. 4. While being held at the inner surface with balloon chucks and a damper, the aluminum cylinder was cut to produce a metal tube having an outer diameter of 310 mm.

Then, the metal tube was provided with an intermediate layer, a charge generation layer and a charge transport layer in the same manner as in Example B1. Furthermore, the resultant metal tube was provided with flanges each having a total runout of 30 μm to produce an electrophotographic photoconductor B7.

The inner-diameter roundness, thickness deviation and squareness were measured with a roundness meter ROND-COM 60A (product of TOKYO SEIMITSU CO., LTD.).

The total runout of each of the extruded tube, metal tube and electrophotographic photoconductor was a runout meter (product of Ricoh Company, Ltd.).

The total runout of the flange was measured with a test indicator (product of Mitutoyo Corporation).

Each of the above-produced electrophotographic photoconductors B1 to B7 was measured for total runout accuracy.

Further, each of electrophotographic photoconductors B1 to B7 was mounted to an image forming apparatus illustrated in FIG. 1, and color reproducibility was evaluated in the same manner as in Examples A1 to A5 and Comparative Examples A1 to A3. The results are shown in Table B1.

TABLE B1

| | | Outer diameter (mm) | Runout (μm) | Image evaluation |
|---|---|---|---|---|
| Electrophotographic photoconductor B1 | Ex. B1 | 150 | 38 | 5 |
| Electrophotographic photoconductor B2 | Ex. B2 | 200 | 59 | 4 |
| Electrophotographic photoconductor B3 | Ex. B3 | 250 | 77 | 4 |
| Electrophotographic photoconductor B4 | Ex. B4 | 300 | 100 | 5 |
| Electrophotographic photoconductor B5 | Comp. Ex. B1 | 150 | 101 | 3 |
| Electrophotographic photoconductor B6 | Comp. Ex. B2 | 300 | 114 | 2 |
| Electrophotographic photoconductor B7 | Comp. Ex. B3 | 310 | 117 | 2 |

What is claimed is:

1. An electrophotographic photoconductor comprising:

a metal tube, and a photoconductive layer on the metal tube, wherein the metal tube has an outer diameter of 150 mm to 300 mm, and has a total runout of 59 μm to 100 μm relative to a driving axis thereof, wherein the metal tube is processed through mandrel extrusion, and has a inner-diameter roundness of 10 μm to 70 μm after the mandrel extrusion.

2. The electrophotographic photoconductor according to claim 1, wherein a single runout is a difference between a maximum value and a minimum value amongst a plurality of measured values of distance between the driving axis and a position on a circumference of the electrophotographic photoconductor, as the electrophotographic photoconductor is rotated once with the driving axis remaining fixed, and the total runout is a maximum value of a plurality of single runouts at respective different positions on the circumference of the electrophotographic photoconductor.

3. An image forming apparatus comprising:

an electrophotographic photoconductor, a charging unit configured to charge a surface of the electrophotographic photoconductor, an exposing unit configured to expose the charged surface of the electrophotographic photoconductor to form a latent electrostatic image, a developing unit configured to develop the latent electrostatic image with a toner to form a visible image, and a transfer unit configured to transfer the visible image onto a recording medium, wherein the electrophotographic photoconductor comprises a metal tube and a photoconductive layer on the metal tube, wherein the metal tube has an outer diameter of 150 mm to 300 mm, and has a total runout of 59 μm to 100 μm relative to a driving axis thereof, and wherein the metal tube is processed through extrustion, and has an inner-diameter roundness of 10 μm to 70 μm after the mandrel extrusion.

4. A process cartridge comprising:

an electrophotographic photoconductor, a developing unit configured to develop, with a toner, a latent electrostatic image on the electrophotographic photoconductor to form a visible image, wherein the electrophotographic photoconductor comprises a metal tube and a photoconductive layer on the metal tube, wherein the metal tube has an outer diameter of 150 mm to 300 mm, and has a total runout of 59 μm to 100 μm relative to a driving axis thereof, wherein the process cartridge is detachably mounted to a main body of an image forming apparatus, and wherein the metal tube is processed through mandrel extrusion, and has an inner-diameter roundness of 10 μm to 70 μm after the mandrel extrusion.

* * * * *